US009311864B2

(12) United States Patent
Chu et al.

(10) Patent No.: US 9,311,864 B2
(45) Date of Patent: Apr. 12, 2016

(54) DISPLAY DEVICE AND METHOD FOR UPDATING IMAGE FRAMES BASED ON IMAGE FRAME SWITCHING PERIOD THEREOF

(75) Inventors: Chia-Hsien Chu, Hsin-Chu (TW); Chun-Chi Lai, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 531 days.

(21) Appl. No.: 13/453,053

(22) Filed: Apr. 23, 2012

(65) Prior Publication Data

US 2013/0135270 A1 May 30, 2013

(30) Foreign Application Priority Data

Nov. 30, 2011 (TW) ..... 100144055 A

(51) Int. Cl.
*G09G 3/34* (2006.01)

(52) U.S. Cl.
CPC ..... *G09G 3/344* (2013.01); *G09G 2300/08* (2013.01); *G09G 2310/061* (2013.01)

(58) Field of Classification Search
CPC ..... G09G 3/344; G02F 1/167
USPC ..... 345/107, 208
See application file for complete search history.

(56) References Cited

U.S. PATENT DOCUMENTS

| | | | | |
|---|---|---|---|---|
| 2001/0026256 | A1 * | 10/2001 | Sugiyama | 345/87 |
| 2003/0233592 | A1 * | 12/2003 | Lin et al. | 713/320 |
| 2006/0050050 | A1 * | 3/2006 | Zhou et al. | 345/107 |
| 2006/0139305 | A1 * | 6/2006 | Zhou et al. | 345/107 |
| 2006/0291032 | A1 | 12/2006 | Zhou et al. | |
| 2007/0273637 | A1 | 11/2007 | Zhou et al. | |
| 2008/0309657 | A1 | 12/2008 | Rhodes et al. | |
| 2009/0046114 | A1 * | 2/2009 | Lee et al. | 345/691 |
| 2009/0179923 | A1 * | 7/2009 | Amundson et al. | 345/690 |

* cited by examiner

*Primary Examiner* — Ram Mistry
(74) *Attorney, Agent, or Firm* — WPAT, P.C.; Justin King; Douglas A. Hosack

(57) ABSTRACT

A method for updating image frames displayed on a display device including charged particles is provided and includes steps as below. A first image frame is displayed according to a first image data value. A second image frame is displayed according to a second image data value. Whether an image frame switching period between the first image frame and the second image frame is less than or equal to a predetermined period is determined to decide an updating manner for the second image frame displayed on the display device. When the image frame switching period is greater than the predetermined period, a reset pulse and a second data pulse are sequentially generated such that the display device operates in a second updating mode. A display device is also disclosed herein.

20 Claims, 7 Drawing Sheets

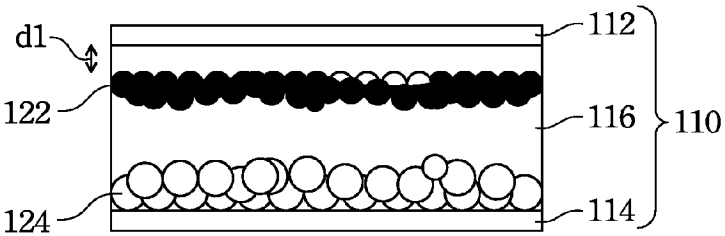
Fig. 6A
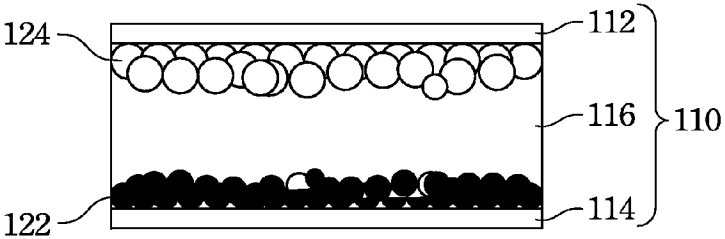
Fig. 6B
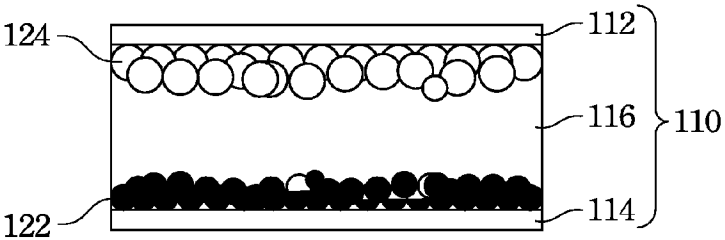
Fig. 6C
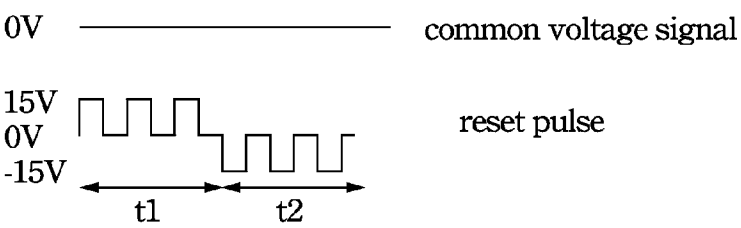
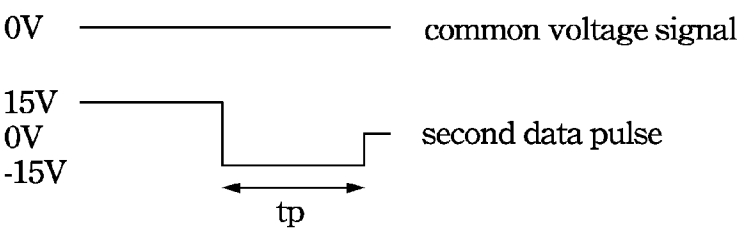

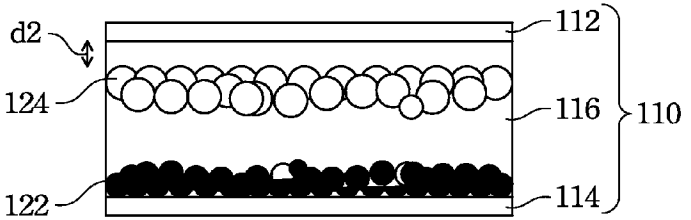
Fig. 7A
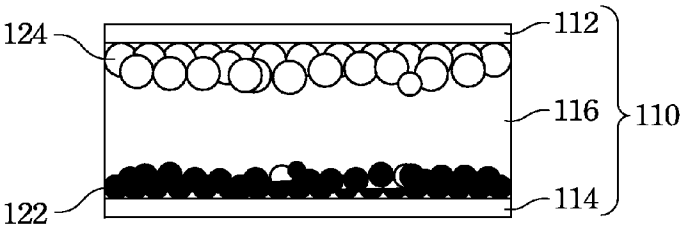
Fig. 7B
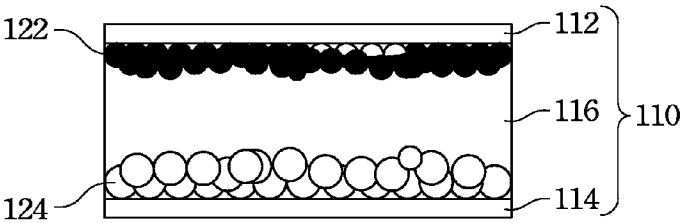
Fig. 7C
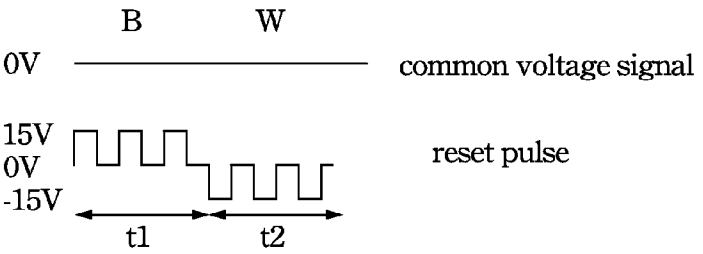
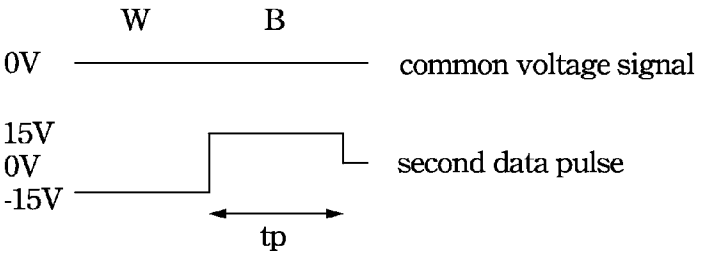

DISPLAY DEVICE AND METHOD FOR UPDATING IMAGE FRAMES BASED ON IMAGE FRAME SWITCHING PERIOD THEREOF

RELATED APPLICATIONS

This application claims priority to Taiwan Patent Application Serial Number 100144055, filed Nov. 30, 2011, which is herein incorporated by reference.

BACKGROUND

1. Technical Field

The present disclosure relates to a method for updating image frames. More particularly, the present disclosure relates to a method for updating image frames displayed on a display device and a display device utilizing the method.

2. Description of Related Art

In a conventional bi-stable display (for example, an electrophoretic display), images are displayed on the display utilizing movements and distributions of charged particles. Advantages of the bi-stable display are that the charged particles in the display can be maintained at distributed positions without applying voltages, so the power consumption can be reduced effectively. Thus, the bi-stable display can be widely applied in portable electronic devices (for example, an electronic paper).

However, the distributed positions of the charged particles shift along with an increase of a image frame switching period such that initial positions of the charged particles change, causing the charged particles cannot be driven by a driving signal corresponding to a next image frame, to move to a corresponding display position, such that the display shows images with ghosting effect. Although there has been a method for updating images that eliminates the ghosting effect, in which a reset signal is added before the driving signal corresponding to the next image frame in order to reset the initial positions of the charged particles, this manner requires a driving signal having a period twice the original period, thus causing a delay of switching image frames and an increase of a temporary storage.

Therefore, a heretofore unaddressed need exists in the art to address the aforementioned deficiencies and inadequacies.

SUMMARY

An aspect of the present invention is related to a method for updating image frames displayed on a display device, in which the display device comprises a plurality of charged particles for receiving and displaying a plurality of image data values, and the charged particles at least comprise a first type of particle and a second type of particle. The method comprises steps as below. A first image data value is received and a first image frame is displayed according to the first image data value. A second image data value is received and a second image frame is displayed according to the second image data value. Whether an image frame switching period between the first image frame and the second image frame is less than or equal to a predetermined period is determined to decide an updating manner for the second image frame displayed on the display device. When the image frame switching period is less than or equal to the predetermined period, a first data pulse is generated for driving the display device such that the display device operates in a first updating mode. When the image frame switching period is greater than the predetermined period, a reset pulse and a second data pulse are sequentially generated for driving the display device such that the display device operates in a second updating mode.

Another aspect of the present invention is related to a display device. The display device comprises a panel and a control unit. The panel comprises a first electrode, a second electrode, a plurality of charged particles and a medium interposed between the first electrode and the second electrode, wherein the medium is configured to contain the charged particles. The control unit is electrically coupled to the panel. The control unit is configured for receiving a plurality of image data values and configured for determining whether an image frame switching period between image frames corresponding to the image data values is less than or equal to a predetermined period to decide if the display device operates in a first updating mode or in a second updating mode. When the display device operates in the first updating mode, the control unit generates a first data pulse for driving the panel such that the charged particles move to a first display position to update an image frame. When the display device operates in the second updating mode, the control unit sequentially generates a reset pulse and a second data pulse for driving the panel such that the charged particles are reset to an initial position and the charged particles then move to a second display position to update the image frame.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference to the accompanying drawings as follows:

FIG. 6A is a diagram illustrating the panel of the display device, which operates in the display mode, according to a third embodiment of the present disclosure;

FIG. 6B is a diagram illustrating the panel of the display device, which operates in the second updating mode, and waveforms of the reset signals, according to a third embodiment of the present disclosure;

FIG. 6C is a diagram illustrating the panel of the display device, which operates in the second updating mode, and waveforms of the driving signals, according to a third embodiment of the present disclosure;

FIG. 7A is a diagram illustrating the panel of the display device, which operates in the display mode, according to a fourth embodiment of the present disclosure;

FIG. 7B is a diagram illustrating the panel of the display device, which operates in the second updating mode, and waveforms of the reset signals, according to a fourth embodiment of the present disclosure; and FIG. 7C is a diagram illustrating the panel of the display device, which operates in the second updating mode, and waveforms of the driving signals, according to a fourth embodiment of the present disclosure.

DESCRIPTION OF THE EMBODIMENTS

In the following description, specific details are presented to provide a thorough understanding of the embodiments of the present invention. Persons of ordinary skill in the relevant art will recognize, however, that the present invention can be practiced without one or more of the specific details, or in combination with other components. Well-known implementations or operations are not shown or described in detail to avoid obscuring aspects of various embodiments of the present invention.

The terms used in this specification generally have their ordinary meanings in the art and in the specific context where each term is used. The use of examples anywhere in this specification, including examples of any terms discussed herein, is illustrative only, and in no way limits the scope and meaning of the invention or of any exemplified term. Likewise, the present invention is not limited to various embodiments given in this specification.

As used herein, the terms "comprising," "including," "having," "containing," "involving," and the like are to be understood to be open-ended, i.e., to mean including but not limited to.

Reference throughout the specification to "one embodiment" or "an embodiment" means that a particular feature, structure, implementation, or characteristic described in connection with the embodiment is included in at least one embodiment of the present invention. Thus, uses of the phrases "in one embodiment" or "in an embodiment" in various places throughout the specification are not necessarily all referring to the same embodiment. Furthermore, the particular features, structures, implementation, or characteristics may be combined in any suitable manner in one or more embodiments.

In the following description and claims, the terms "coupled" and "connected", along with their derivatives, may be used. In particular embodiments, "connected" and "coupled" may be used to indicate that two or more elements are in direct physical or electrical contact with each other, or may also mean that two or more elements may not be in direct contact with each other. "Coupled" may still be used to indicate that two or more elements cooperate or interact with each other.

Figure 1:
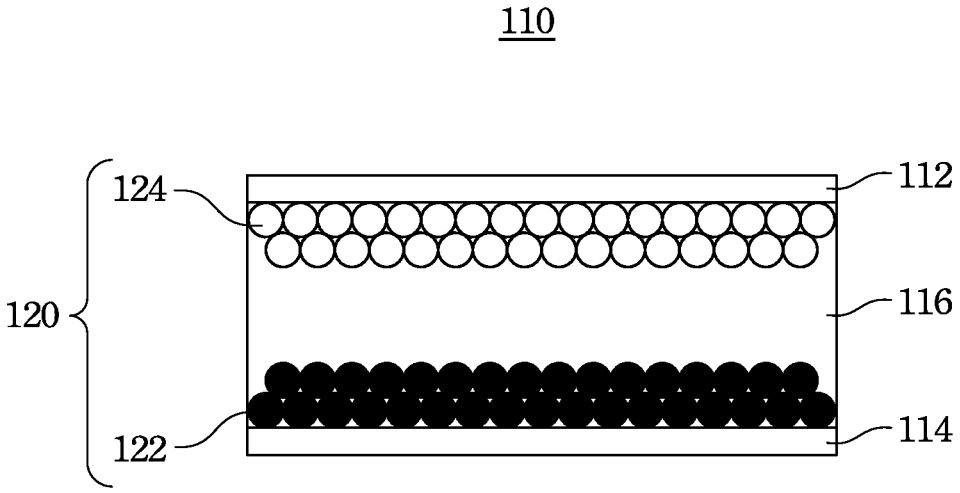
FIG. 1 is a diagram illustrating a panel according to one embodiment of the present disclosure.

FIG. 1 is a diagram illustrating a panel according to one embodiment of the present disclosure. The panel 110 may include a first electrode 112, a second electrode 114, a plurality of charged particles 120 and a medium 116 interposed between the first electrode 112 and the second electrode 114, in which the medium 116 is configured to contain the charged particles 120. The charged particles 120 at least include first type of particles 122 and second type of particles 124, in which the first type of particles 122 and the second type of particles 124 have first charges and second charges, respectively, and the first charges are different from the second charges; for example, the first type of particles 122 have positive charges, and the second type of particles 124 have negative charges. Furthermore, the first type of particles 122 and the second type of particles 124 have colors that are different from or in contrast to each other; for example, the first type of particles 122 may be black, and the second type of particles 124 may be white. It is noted that the medium 116 in the present embodiment can be a micro-cup array filled with an electrophoretic fluid.

Figure 2:
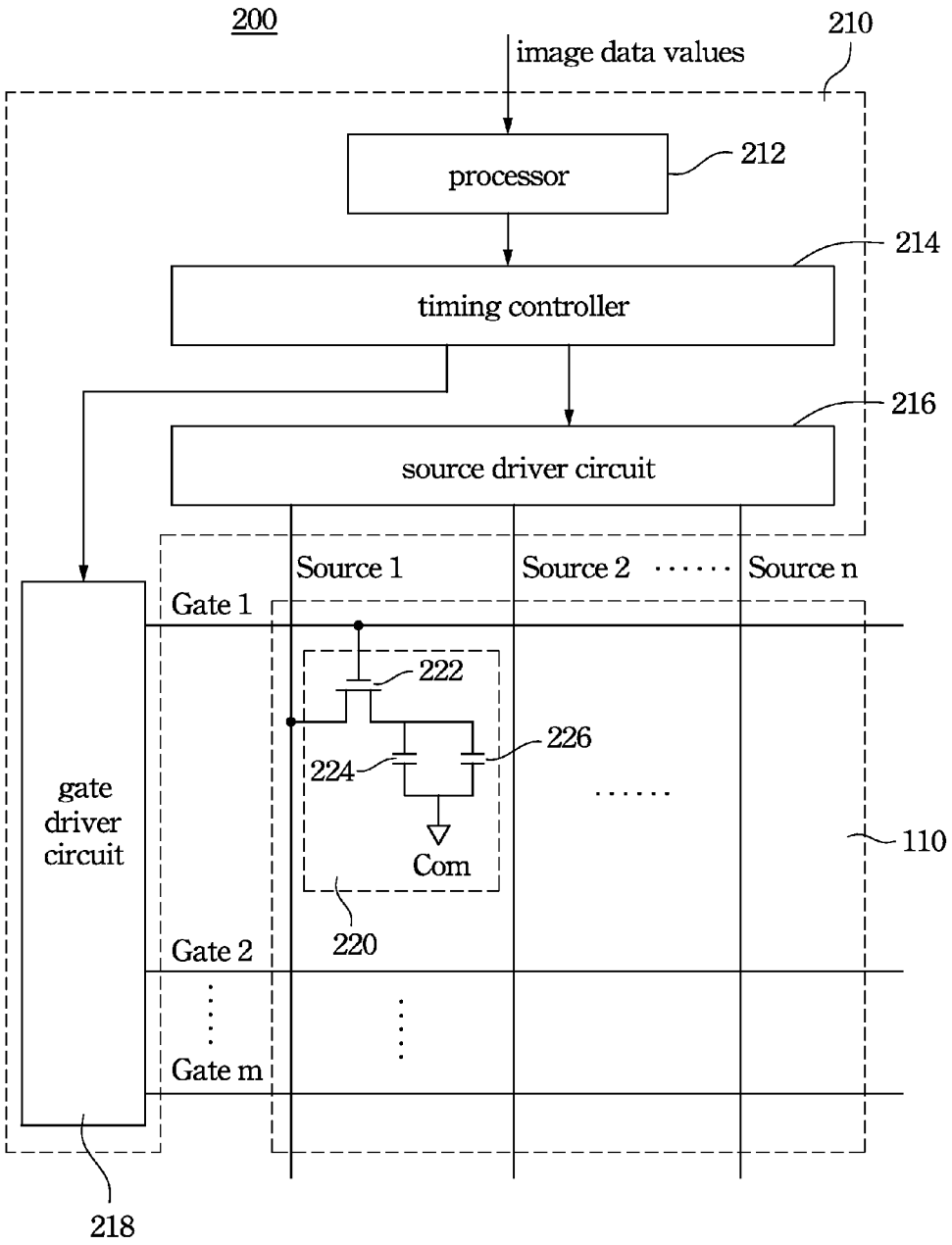
FIG. 2 is a circuit block diagram illustrating a display device according to one embodiment of the present disclosure.

FIG. 2 is a circuit block diagram illustrating a display device according to one embodiment of the present disclosure. The display device 200 includes the panel 100 as shown in FIG. 1 and a control unit 210, in which the panel 100 further includes a plurality of pixel units 220, and each of the pixel units 220 may include a transistor 222, a storage capacitor 224 and a liquid crystal capacitor 226. The control unit 210 may include a processor 212, a timing controller 214, a source driver circuit 216 and a gate driver circuit 218. The processor 212 is configured for receiving a plurality of image data values and configured for determining whether an image frame switching period between image frames corresponding to the image data values is less than or equal to a predetermined period (e.g., 30 seconds) to decide if the display device 200 operates in a first updating mode (e.g., a short-time image frame switching mode) or in a second updating mode (e.g., a long-time image frame switching mode), and the processor 212 generates a processing signal accordingly. The timing controller 214 is electrically coupled to the processor 212, configured for receiving the processing signal, and configured for generating a corresponding source control signal and a corresponding gate control signal for the source driver circuit 216 and the gate driver circuit 218, respectively. The source driver circuit 216 is electrically coupled between the timing controller 214 and the panel 110, configured for receiving the source control signal, and configured for generating a corresponding source driving signal for driving the pixel units 220 of the panel 110.

When the display device 200 operates in the first updating mode, the source driving signal generated by the control unit 210 includes a first data pulse for driving the panel 110, such that the charged particles 120 move to a first display position in the medium 116, so as to generate a new image frame (or to update an image frame). When the display device 200 operates in the second updating mode, the source driving signal generated by the control unit 210 includes a reset pulse and a second data pulse for driving the panel 110, such that the charged particles 120 can be reset to an initial position in the medium 116 according to a waveform and a potential of the reset pulse, and then the charged particles 120 can move to a second position in the medium 116 according to a waveform and a potential of the second data pulse to generate a new image frame (or to update the image frame). In the present embodiment, one side of the panel 110, which is close to the first electrode 112, may be a display terminal; that is, when the first type of particles 122 that are black are distributed in the medium 116 and close to the first electrode 112, the panel 110 may display a black image frame, and on the other hand, when the second type of particles 124 that are white are distributed in the medium 116 and close to the first electrode 112, the panel 110 may display a white image frame.

It is noted that, in the embodiments of the present disclosure, a common voltage signal (e.g., a voltage signal of 0 volts) may further be provided for the first electrode 112, such that a voltage difference between the first electrode 112 and the second electrode 114 can be generated for attracting or rejecting the first type of particles 122 and the second type of particles 124. Thus, according to the potential of the first data pulse and the second data pulse provided for the second electrode 114, the first type of particles 122 and the second type of particles 124 may move and be distributed correspondingly in the medium 116, so as to display the image frames corresponding to the image data values. In addition, the colors and the charge polarities of the first type of particles 122 and the second type of particles 124 are not limited to those as illustrated in the foregoing embodiments.

Figure 3:
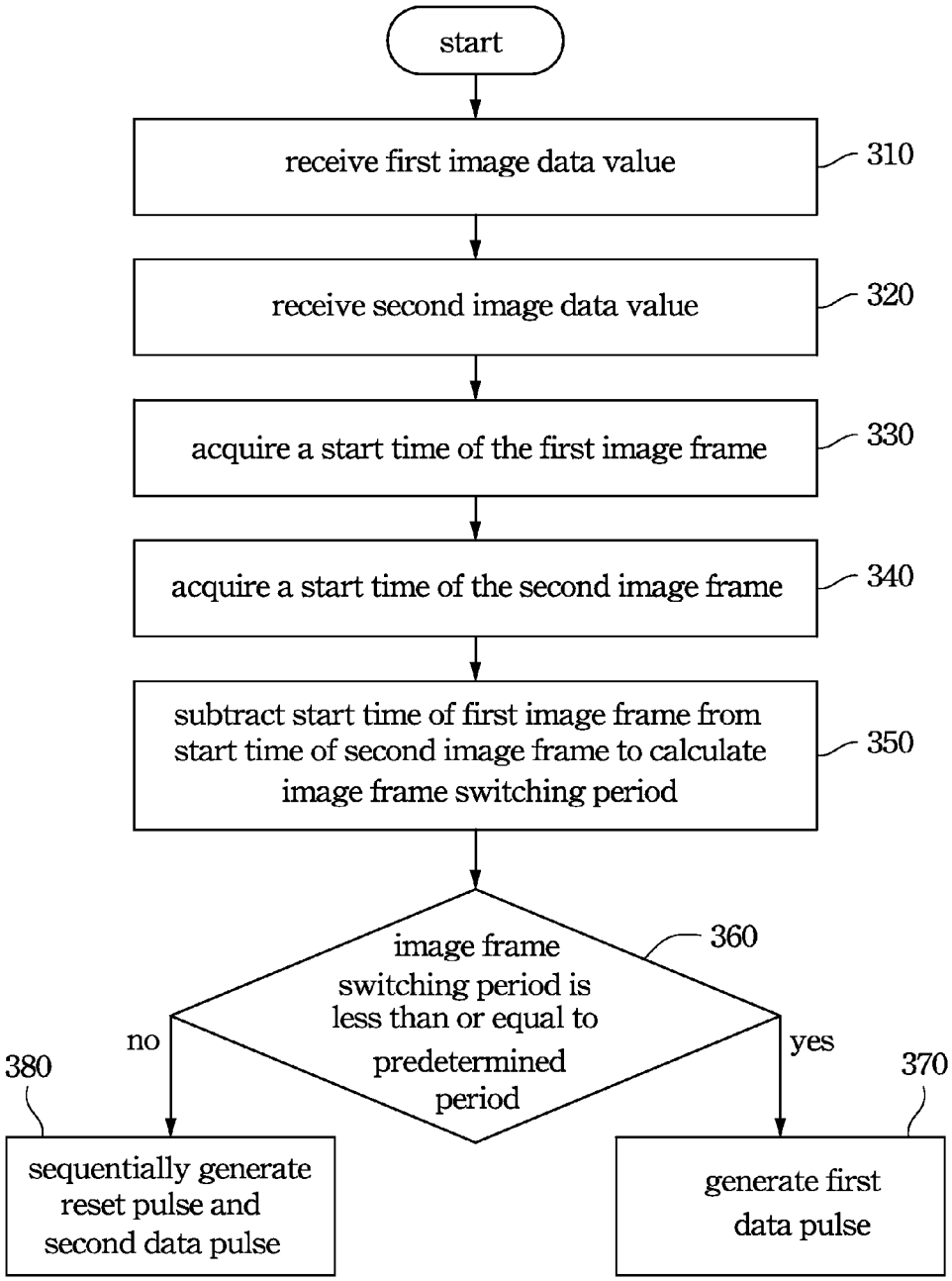
FIG. 3 is a flow chart of a method for updating image frames displayed on a display device according to one embodiment of the present disclosure.

FIG. 3 is a flow chart of a method for updating image frames displayed on a display device according to one embodiment of the present disclosure. In practice, the method for updating image frames is applicable for a panel which is similar to the panel 110 as shown in FIG. 1 and also applicable for a display device which is similar to the display device 200 as shown in FIG. 2, structures and configurations of the panel and the display device are the same as or similar to those shown in the aforementioned embodiments, and thus they are not described in further detail herein. For convenience of description, the method for updating image frames is described below in conjunction with the embodiments as shown in FIG. 1 and FIG. 2.

In the present embodiment, the method for updating image frames displayed on the display device 200 includes steps as below. First, in step 310, the processor 212 may receive a first image data value, and a first image frame (e.g., a present image frame) is displayed according to the first image data value. Then, in step 320, the processor 212 may receive a second image data value, and a second image frame (e.g., a next image frame) is displayed according to the second image data value. Thereafter, in step 330, the processor 212 may acquire a start time of the first image frame according to a real time clock (RTC). Then, in step 340, the processor 212 may acquire a start time of the second image frame according to the real time clock. Afterward, in step 350, the processor 212 may subtract the start time of the first image frame from the start time of the second image frame to calculate the image frame switching period. It is noted that, in the present disclosure, the manner of acquiring the start time of each image frame and the manner of calculating the image frame switching period are not limited to the steps 330-350 as described above.

Thereafter, in step 360, the processor 212 may determine whether the image frame switching period between the first image frame and the second image frame is less than or equal to a predetermined period to decide an updating manner for the second image frame displayed on the display device 200. As shown in step 370, when the image frame switching period is less than or equal to the predetermined period (i.e., the image frame switching period is shorter), the processor 212 can generate the corresponding first data pulse for the timing controller 214, such that the panel 110 is driven by the first data pulse to operate in the first updating mode (or the short-time image frame switching mode). As shown in step 380, when the image frame switching period is greater than the predetermined period (i.e., the image frame switching period is longer), the processor 212 can generate the corresponding processing signal for the timing controller 214, such that the panel 110 is driven sequentially by the reset pulse and the second data pulse to operate in the second updating mode (or the long-time image frame switching mode).

Figure 4A:
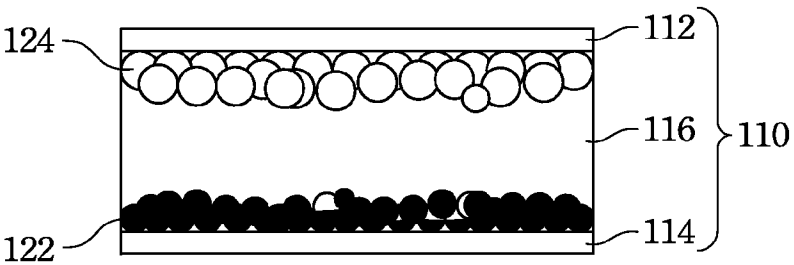
FIG. 4A is a diagram illustrating the panel of the display device, which operates in a display mode, according to a first embodiment of the present disclosure.
Figure 4B:
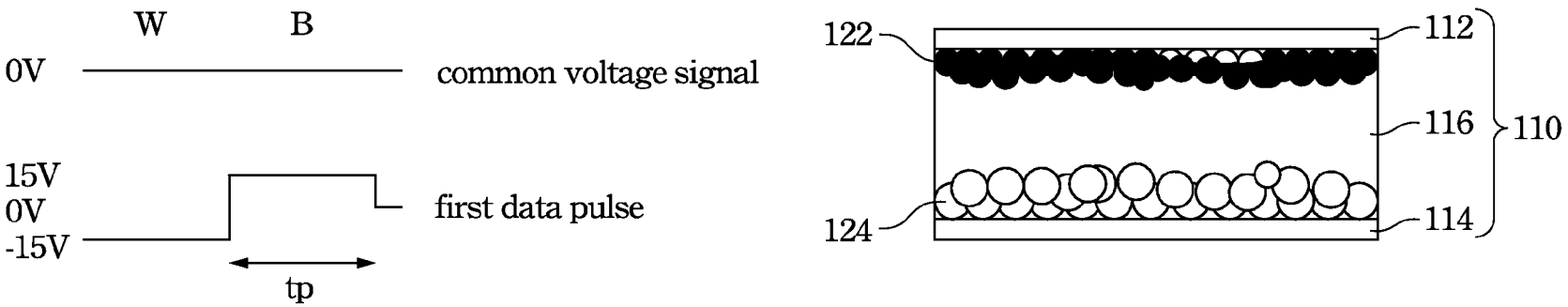
FIG. 4B is a diagram illustrating the panel of the display device, which operates in the first updating mode, and waveforms of the driving signals, according to a first embodiment of the present disclosure.

FIG. 4A is a diagram illustrating the panel of the display device, which operates in a display mode, according to a first embodiment of the present disclosure. FIG. 4B is a diagram illustrating the panel of the display device, which operates in the first updating mode, and waveforms of the driving signals, according to a first embodiment of the present disclosure. As shown in FIG. 4A and FIG. 4B, the panel 110 illustrated hereinafter is described in the embodiment as shown in FIG. 1, and thus it is not described in further detail herein. When the image frame is to be switched from being white to being black and the image frame switching period is less than or equal to the predetermined period (e.g., 30 seconds), the first data pulse rises from a negative voltage level (e.g., a voltage level of −15 volts) to a positive voltage level (e.g., a voltage level of +15 volts) to reject the first type of particles 122 with the positive charges, such that the first type of particles 122 move and are distributed close to one side of the first electrode 112, in the medium 116. Meanwhile, the second type of particles 124 with the negative charges are attracted based on the first data pulse having the positive voltage level, such that the second type of particles 124 move and are distributed close to one side of the second electrode 114, in the medium 116, and the panel 110 can thus display a gray-level image frame which is a black image frame.

Figure 5A:
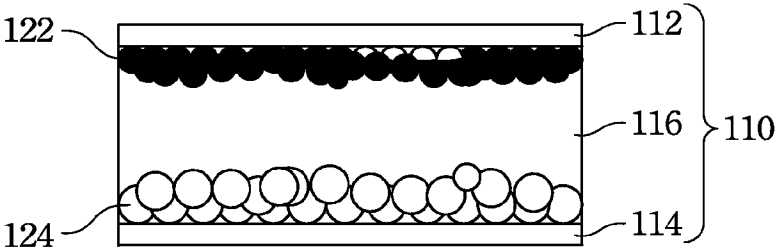
FIG. 5A is a diagram illustrating the panel of the display device, which operates in the display mode, according to a second embodiment of the present disclosure.
Figure 5B:
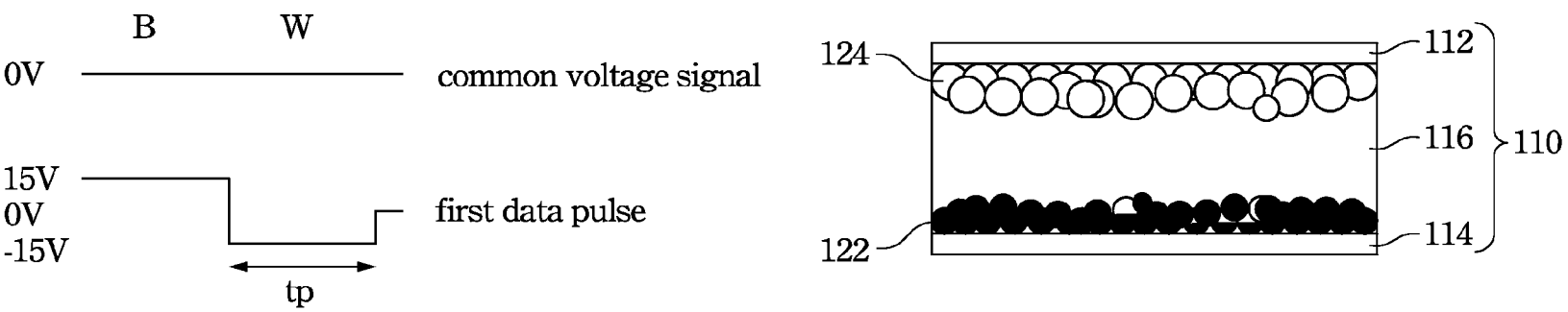
FIG. 5B is a diagram illustrating the panel of the display device, which operates in the first updating mode, and waveforms of the driving signals, according to a second embodiment of the present disclosure.

FIG. 5A is a diagram illustrating the panel of the display device, which operates in the display mode, according to a second embodiment of the present disclosure. FIG. 5B is a diagram illustrating the panel of the display device, which operates in the first updating mode, and waveforms of the driving signals, according to a second embodiment of the present disclosure. As shown in FIG. 5A, the first type of particles 122 are distributed close to one side of the first electrode 112, in the medium 116, and the second type of particles 124 are distributed close to one side of the second electrode 114, in the medium 116, such that the panel 110 can thus display the gray-level image frame which is the black image frame. As shown in FIG. 5B, when the image frame is to be switched from being black to being white and the image frame switching period is less than or equal to the predetermined period (e.g., 30 seconds), the first data pulse falls from the positive voltage level (e.g., the voltage level of +15 volts) to the negative voltage level (e.g., the voltage level of −15 volts) to reject the second type of particles 124 with the negative charges, such that the second type of particles 124 move and are distributed close to one side of the first electrode 112, in the medium 116. Meanwhile, the first type of particles 122 with the positive charges are attracted based on the first data pulse having the negative voltage level, such that the first type of particles 122 move and are distributed close to one side of the second electrode 114, in the medium 116, and the panel 110 can thus display a gray-level image frame which is a white image frame.

In the foregoing and following embodiments, each of the first data pulse and the second data pulse may include at least one of a pulse width modulation (PWM) signal, a frequency modulation signal, a voltage modulation signal, and an amplitude modulation signal, and at least one of a pulse width, a frequency, a voltage, and an amplitude of each of the first data pulse and the second data pulse is adjustable for changing distributions of the first type of particles 122 and the second type of particles 124 in the panel 110 to generate a plurality of gray levels (e.g., 16 gray levels) and to display the image frames corresponding to the image data values.

FIG. 6A is a diagram illustrating the panel of the display device, which operates in the display mode, according to a third embodiment of the present disclosure. As shown in FIG. 6A, the first type of particles 122 are distributed close to one side of the first electrode 112 in the medium 116, and the second type of particles 124 are distributed close to one side of the second electrode 114, in the medium 116, such that the panel 110 can thus display the gray-level image frame which is the black image frame. In the present embodiment, the image frame switching period is greater than the predetermined period (e.g., 30 seconds), so the distributed positions of the first type of particles 122 which are close to one side of the first electrode 112, in the medium 116, are shifted by a distance of d1.

FIG. 6B is a diagram illustrating the panel of the display device, which operates in the second updating mode, and waveforms of the reset signals, according to a third embodiment of the present disclosure. As shown in FIG. 6B, when the image frame is to be switched from being black to being white and the image frame switching period is greater than the predetermined period (e.g., 30 seconds), the reset pulse can first be provided for the second electrode 114 to reset the first type of particles 122 and the second type of particles 124. The reset pulse has a first reset period t1 and a second reset period t2 in which the first type of particles 122 and the second type of particle 124 are reset to a first initial position (e.g., a position close to one side of the second electrode 114) and a second initial position (e.g., a position close to one side of the first electrode 112), respectively, in the medium 116.

FIG. 6C is a diagram illustrating the panel of the display device, which operates in the second updating mode, and waveforms of the driving signals, according to a third embodiment of the present disclosure. As shown in FIG. 6C, after the charged particles 120 are reset, the second data pulse is provided for the second electrode 114 to change the distributions of the charged particles 120. At that moment, the second data pulse can fall to the negative voltage level (e.g., the voltage level of −15 volts) to reject the second type of particles 124 with the negative charges, such that the second type of particles 124 move and are distributed close to one side of the first electrode 112, in the medium 116. Meanwhile, the first type of particles 122 with the positive charges are attracted based on the second data pulse having the negative voltage level, such that the first type of particles 122 move and are distributed close to one side of the second electrode 114, in the medium 116, and the panel 110 can thus display a gray-level image frame which is the white image frame.

FIG. 7A is a diagram illustrating the panel of the display device, which operates in the display mode, according to a fourth embodiment of the present disclosure. FIG. 7B is a diagram illustrating the panel of the display device, which operates in the second updating mode, and waveforms of the reset signals, according to a fourth embodiment of the present disclosure. FIG. 7C is a diagram illustrating the panel of the display device, which operates in the second updating mode, and waveforms of the driving signals, according to a fourth embodiment of the present disclosure.

Similarly, as shown in FIG. 7A, FIG. 7B and FIG. 7C, when the image frame switching period is greater than the predetermined period, the distributed positions of the second type of particles 124 which are close to one side of the first electrode 112, in the medium 116, are shifted by a distance of d2. Thus, the first type of particles 122 and the second type of particles 124 can be reset or driven by the reset pulse, such that the first type of particles 122 and the second type of particles 124 move back to the initial positions in the medium 116. Afterward, the first type of particles 122 and the second type of particles 124 are driven by the second data pulse, such that the first type of particles 122 and the second type of particles 124 move and are distributed at the corresponding positions in the medium 116, and the gray level image frame which is the white image frame (as can be displayed on the panel 110 shown in FIG. 7B) can thus be switched to the gray level image frame which is the black image frame (as can be displayed on the panel 110 shown in FIG. 7C). The operations mentioned in the embodiments as shown in FIG. 7A-FIG. 7C are the same as or similar to those mentioned in the embodiments as shown in FIG. 6A-FIG. 6C, and thus they are not described in further detail herein.

Compared to the skill in the prior art, in the embodiments of the present disclosure, whether the reset pulse is added to reset the charged particles or not can be ascertained by determining the image frame switching period between two adjacent image frames. Furthermore, if a display device has 16 gray levels, only 257 types of the driving signals are required to complete the switching of the image frames corresponding to all of the gray levels, in which the 256 types of the driving signals are driving signals required when the image frames corresponding to all of the 16 gray levels switch therebetween, and the rest one driving signal is the reset pulse for avoiding the shifts of the distributed positions of the charged particles, which occur when the image frame switching period is too long, such that the charged particles can move to the right display positions when the image frame is switched to the next image frame. Therefore, the present disclosure can be applied with the advantages such as improving the images with ghosting effect, shortening the image frame switching period, saving a temporary storage for storing the driving signals, etc.

The steps are not necessarily recited in the sequence in which the steps are performed. That is, unless the sequence of the steps is expressly indicated, the sequence of the steps is interchangeable, and all or part of the steps may be simultaneously, partially simultaneously, or sequentially performed.

As is understood by a person skilled in the art, the foregoing embodiments of the present invention are illustrative of the present invention rather than limiting of the present invention. It is intended to cover various modifications and similar arrangements included within the spirit and scope of the appended claims, the scope of which should be accorded with the broadest interpretation so as to encompass all such modifications and similar structures.

What is claimed is:

1. A method for updating image frames displayed on a display device, wherein the display device comprising a plurality of charged particles for receiving and displaying a plurality of image data values, the charged particles at least comprising a first type of particle and a second type of particle, the method comprising:

receiving a first image data value and displaying a first image frame according to the first image data value;

receiving a second image data value being different from the first image data value;

determining whether an image frame switching period between the first image frame and a second image frame is less than or equal to a predetermined period after receiving the second image data value to decide an updating manner to the second image frame, and the image frame switching period is a time interval between a start time of the first image frame and a start time of the second image frame; and displaying the second image frame being different from the first image frame according to the second image data value;

when the image frame switching period is less than or equal to the predetermined period, generating a first data pulse corresponding to the second image data value for driving the display device such that the display device operates in a first updating mode; and when the image frame switching period is greater than the predetermined period, sequentially generating a reset pulse and a second data pulse corresponding to the second image data value for driving the display device such that the display device operates in a second updating mode.

2. The method as claimed in claim 1, further comprising:

acquiring the start time of the first image frame;

acquiring the start time of the second image frame; and subtracting the start time of the first image frame from the start time of the second image frame to calculate the image frame switching period.

3. The method as claimed in claim 1, wherein each of the first data pulse and the second data pulse comprises at least one of a pulse width modulation signal, a frequency modulation signal, a voltage modulation signal, and an amplitude modulation signal.

4. The method as claimed in claim 3, wherein at least one of a pulse width, a frequency, a voltage, and an amplitude of each of the first data pulse and the second data pulse is adjustable for changing a distribution of the charged particles in the display device to display image frames corresponding to the image data values.

5. The method as claimed in claim 1, wherein the reset pulse has a first reset period and a second reset period in which the first type of particle and the second type of particle are reset to a first initial position and a second initial position, respectively.

6. The method as claimed in claim 5, further comprising:

after the first type of particle and the second type of particle are reset, the first type of particle is driven by the second data pulse to move to a first display position or a second display position, and the second type of particle is driven by the second data pulse to move to the second display position or the first display position, which is opposite to the position of the first type of particle.

7. The method as claimed in claim 1, wherein when the display device operates in the first updating mode, the first type of particle is driven by the first data pulse to move to a first display position or a second display position, and the second type of particle is driven by the first data pulse to move to the second display position or the first display position, which is opposite to the position of the first type of particle.

8. The method as claimed in claim 1, wherein the first type of particle and the second type of particle have a first charge and a second charge, respectively, and the first charge is different from the second charge.

9. The method as claimed in claim 1, wherein the first type of particle and the second type of particle have colors that are different from or in contrast to each other.

10. A display device comprising:

a panel comprising a first electrode, a second electrode, a plurality of charged particles and a medium interposed between the first electrode and the second electrode, wherein the medium is configured to contain the charged particles; and a control unit electrically coupled to the panel, the control unit configured for receiving a plurality of image data values and configured for determining whether an image frame switching period between a present image frame and a next image frame corresponding to the image data values is less than or equal to a predetermined period after receiving the image data values to decide if the display device operates in a first updating mode or in a second updating mode, wherein when the display device operates in the first updating mode, the control unit generates a first data pulse for driving the panel such that the charged particles move to a first display position to update from the present image frame to the next image frame, in which the present image frame is different from the next image frame, and when the display device operates in the second updating mode, the control unit sequentially generates a reset pulse and a second data pulse for driving the panel such that the charged particles are reset to an initial position and the charged particles then move to a second display position to update the image frame from the present image frame to the next image frame, wherein the present image frame is different from the next image frame, the image data value of the present image frame is different from the image data value of the next image frame and the image frame switching period is a time interval between a start time of the present image frame a start time of the next image frame.

11. The display device as claimed in claim 10, wherein the control unit comprises a processor, a timing controller and a source driver circuit.

12. The display device as claimed in claim 10, wherein the charged particles comprise a first type of particle and a second type of particle.

13. The display device as claimed in claim 12, wherein the first type of particle and the second type of particle have a first charge and a second charge, respectively, and the first charge is different from the second charge.

14. The display device as claimed in claim 12, wherein the first type of particle and the second type of particle have colors that are different from or in contrast to each other.

15. The display device as claimed in claim 12, wherein the reset pulse has a first reset period and a second reset period in which a first type of particle and a second type of particle of the charged particles are reset to a first initial position and a second initial position, respectively.

16. The display device as claimed in claim 15, wherein after the first type of particle and the second type of particle are reset, the first type of particle and the second type of particle are driven by the second data pulse to move to corresponding positions which are opposite to each other.

17. The display device as claimed in claim 12, wherein each of the first data pulse and the second data pulse comprises at least one of a pulse width modulation signal, a frequency modulation signal, a voltage modulation signal, and an amplitude modulation signal.

18. The display device as claimed in claim 10, wherein when the display device operates in the first updating mode, a first type of particle and a second type of particle of the charged particles are driven by the first data pulse to move to corresponding positions which are opposite to each other.

19. The display device as claimed in claim 10, wherein the first type of particle is black, the second type of particle is white, and the medium is a micro-cup array filled with an electrophoretic fluid.

20. A method for updating image frames displayed on a display device, comprising a plurality of charged particles for receiving and displaying a plurality of image data values, wherein the charged particles comprise a first type of particle and a second type of particle, the method comprising:

receiving a first image data value and displaying a first image frame according to the first image data value;

receiving a second image data value different from the first image data value for displaying a second image frame according to the second image data value;

calculating whether a switching period between a first start time of said displaying the first image frame and a second start time of said displaying the second image frame is greater than a predetermined period;

if said switching period is less than or equal to said predetermined period, then using a first updating mode to display the second image frame according to said second image data value, wherein said first updating mode comprises applying a pulse having a first polarity according to said second image value to the charged particles, and not applying any pulse having a second polarity opposite the first polarity to the charged particles; and if said switching period is greater than said predetermined period, then using a second updating mode to display the second image frame according to said second image data value when the switching period is greater than the predetermined period, wherein said second updating mode comprises applying the pulse having the first polarity according to said second image value to the charged particles, and applying at least one pulse having the second polarity opposite the first polarity to the charged particles.

* * * * *